US006658331B2

(12) United States Patent
Horst et al.

(10) Patent No.: US 6,658,331 B2
(45) Date of Patent: Dec. 2, 2003

(54) REMOTE CONTROL UNIT FOR LOCOMOTIVE INCLUDING DISPLAY MODULE FOR DISPLAYING COMMAND INFORMATION

(75) Inventors: Folkert Horst, Pierrefonds (CA); Oleh Szklar, St-Hubert (CA)

(73) Assignee: Canac, Inc., Saint-Laurent (CA)

( * ) Notice: Subject to any disclaimer, the term of this patent is extended or adjusted under 35 U.S.C. 154(b) by 0 days.

(21) Appl. No.: 10/102,220

(22) Filed: Mar. 19, 2002

(65) Prior Publication Data

US 2003/0182029 A1 Sep. 25, 2003

(51) Int. Cl.[7] ..... G06F 7/00; B61L 3/00

(52) U.S. Cl. ..... 701/19; 701/20; 246/187 A; 345/700

(58) Field of Search ..... 701/19, 20, 1, 701/24; 246/167 R, 191, 187 A, 182 AB, 182 A, 182 R; 345/700, 660; 340/438

(56) References Cited

U.S. PATENT DOCUMENTS 5,340,062 A * 8/1994 Heggestad ..... 246/5

5,564,657 A * 10/1996 Dimsa et al. ..... 246/187 A

* cited by examiner

*Primary Examiner*—Tan Q. Nguyen
(74) *Attorney, Agent, or Firm*—Merchant & Gould, P.C.

(57) ABSTRACT

A remote control unit for controlling a locomotive is provided. The remote control unit includes a manually operable control device, a brake setting display and a display controller. The control device allows an operator to select a level of brake application. The brake setting display includes an array of discrete display elements. The display controller actuates a first display element when a first level of brake application is selected on the control device. The display controller actuates a second display element adjacent to the first display element when a third level of brake application is selected on the control device. The display controller actuates the first and that second display elements of the array when a second level of brake application that is intermediate to the first and third levels of brake application is selected on the control device. Alternatively, the remote control unit includes manually operable control devices, a setting displays and display controllers for controlling and displaying speed or throttle settings in a similar fashion as that of the brake setting.

44 Claims, 6 Drawing Sheets

206 ○ FULL
208 ○ MEDIUM
210 ○ LIGHT
212 ● MINIMUM

FIG. 4A

206 ○ FULL
208 ○ MEDIUM
210 ◐ LIGHT
212 ● MINIMUM

FIG. 4B

206 ○ FULL
208 ○ MEDIUM
210 ● LIGHT
212 ● MINIMUM

FIG. 4C

206 ○ FULL
208 ◐ MEDIUM
210 ● LIGHT
212 ● MINIMUM

FIG. 4D

206 ○ FULL
208 ● MEDIUM
210 ● LIGHT
212 ● MINIMUM

FIG. 4E

206 ◐ FULL
208 ● MEDIUM
210 ● LIGHT
212 ● MINIMUM

FIG. 4F

206 ● FULL
208 ● MEDIUM
210 ● LIGHT
212 ● MINIMUM

FIG. 4G

REMOTE CONTROL UNIT FOR LOCOMOTIVE INCLUDING DISPLAY MODULE FOR DISPLAYING COMMAND INFORMATION

FIELD OF THE INVENTION

The present invention relates to remote control units for locomotive and, more particularly, to remote control units for locomotives including display modules for displaying command information such as speed, throttle and brake setting information.

BACKGROUND OF THE INVENTION

Economic constraints have led railway companies to develop portable units allowing a ground-based operator to remotely control a locomotive in a switching yard. The module is essentially a transmitter communicating with a trail controller on the locomotive by way of a radio link. Typically, the operator carries this module and can perform duties such as coupling, and uncoupling cars while remaining in control of the locomotive movement at all times. This allows for placing the point of control at the point of movement thereby potentially enhancing safety, accuracy and efficiency.

Typically, such remote control units include displays indicating the status of the commands being transmitted to the locomotive such as brake setting information, throttle setting information, speed setting information and so on. Generally, the display includes a set of light emitting diodes (LEDs) associated to respective settings corresponding to brake setting information, throttle setting information or speed setting information. For example, a display indicating current brake setting information may include includes six indicators associated to the following brake settings: release; minimum; light; medium; full; charge. The indicators allow the system to display to the operator of the remote control unit 4 levels of the brake setting application (minimum; light; medium; full) in addition to the release and charge settings by turning the corresponding LED "ON" while the other LEDs remain "OFF".

A deficiency with displays of the type described above is that in order to indicate an additional level, an additional LED must be added to the display. Such an addition requires the redesign of the layout of the display module as well as that of the underlying hardware. Such a redesign is costly and therefore limits of the amount of flexibility of the remote control unit.

Accordingly, there exists a need in the industry to provide a remote control unit for a locomotive including a display module that alleviates at least some of the problems associated with prior art devices.

SUMMARY OF THE INVENTION

In accordance with a broad aspect, the present invention provides a remote control unit for controlling a locomotive where the remote control unit includes a manually operable control device, a brake setting display and a display controller in communication with the control device and with the brake setting display. The manually operable control device allows an operator to select a brake setting among a set of brake settings where the brake setting in the set of brake settings correspond to respective levels of brake application. The brake setting display includes an array of discrete display elements. The display controller is responsive to the manually operable control device to actuate a first display element of the array when a first brake setting is selected on the control device, where the first brake setting corresponds to a first level of brake application. The display controller is responsive to the manually operable control device to actuate a second display element adjacent to the first display element when a third brake setting is selected on the control device, where the third brake setting corresponds to a third level of brake application. The display controller is also responsive to the manually operable control device to actuate the first and the second display elements of the array when a second brake setting is selected on the control device. The second brake setting corresponds to a second level of brake application that is intermediate to the first and third levels of brake application.

Advantageously, the invention allows expanding the number of brake settings that can be represented on a remote control unit with a given number of discrete display elements without requiring the increasing the number of discrete display elements.

In a specific implementation, the array of discrete display elements includes display elements that are linearly arranged. In a non-limiting implementation, the display elements of the array are arranged along a straight line and the display elements of said array are light emitting diodes (LEDs).

In a specific implementation, the display module is a moving dot display. In this first specific implementation, when the first brake setting is selected on the control device corresponding to a first level of brake application, the brake setting display actuates the first display element and the second display element is de-actuated. Similarly, when the third brake setting is selected on the control device corresponding to a third level of brake application, the brake setting display actuates the second display element and the first display element is de-actuated. When the second brake setting is selected on the control device, corresponding to the second level of brake application, the brake setting display is operative to actuate the first display element and the second display element in an identical manner. It will be readily apparent that the first display element and the second display element may be actuated is different manners without detracting from the spirit of the invention.

In an alternative specific implementation, the display module is a bar graph display.

In a specific example of implementation the remote control unit is portable. The remote control unit includes a command generator responsive to the control device to produce a message for causing brakes of the locomotive to be applied at a level corresponding to the brake setting selected at the manually operable control device. The remote control unit includes a transmitter in communication with the command generator for producing an RF signal containing the message.

In accordance with another broad aspect, the invention provides a remote control unit for controlling a locomotive including a manually operable control device, a speed setting display and a display controller in communication with the control device and with the speed setting display. The manually operable control device allows an operator to select a speed setting among a set of speed settings. The speed setting display includes an array of discrete display elements. The display controller is to the manually operable control device to actuate a first display element of the array when a first speed setting is selected on the control device. The display controller is to the manually operable control device to actuate a second display element adjacent to the first display element when a third speed setting is selected on the control device. The display controller is to the manually operable control device to actuate the first and second display elements of the array when a second speed setting is selected on the control device, where the second speed setting is intermediate to the first and third speed settings.

In accordance with another broad aspect, the invention provides a remote control unit for controlling a locomotive including a manually operable control device, a throttle setting display and a display controller in communication with the control device and with the throttle setting display. The manually operable control device allows an operator to select a throttle setting among a set of throttle settings. The throttle setting display including an array of discrete display elements. The display controller is responsive to the manually operable control device to actuate a first display element of the array when a first throttle setting is selected on the control device. The display controller is responsive to the manually operable control device to actuate a second display element adjacent to the first display element when a third throttle setting is selected on the control device. The display controller is responsive to the manually operable control device to actuate the first and the second display elements of the array when a second throttle setting is selected on the control device, where the second throttle setting being intermediate to the first and the third throttle settings.

In accordance with a broad aspect, the present invention provides a remote control unit for controlling a locomotive where the remote control unit includes a manually operable control device, a brake setting display and a display controller in communication with the control device and with the brake setting display. The manually operable control device allows an operator to select a brake setting among a set of brake settings where the brake setting in the set of brake settings correspond to respective levels of brake application. The brake setting display includes an array of discrete display elements. The display controller is responsive to the manually operable control device to actuate a first display element of the array in a first manner of actuation when a first brake setting, corresponding to a first level of brake application, is selected on the control device. The display controller is responsive to the manually operable control device to actuate the first display element in a second manner of actuation when a second brake setting, corresponding to a second level of brake application, is selected on the control device, the second manner of actuation being distinct from the first manner of actuation.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

FIGS. 4*a* to 4*g* illustrate a second display scheme in accordance with a non-limiting example of implementation of the present invention;

Figure 1:
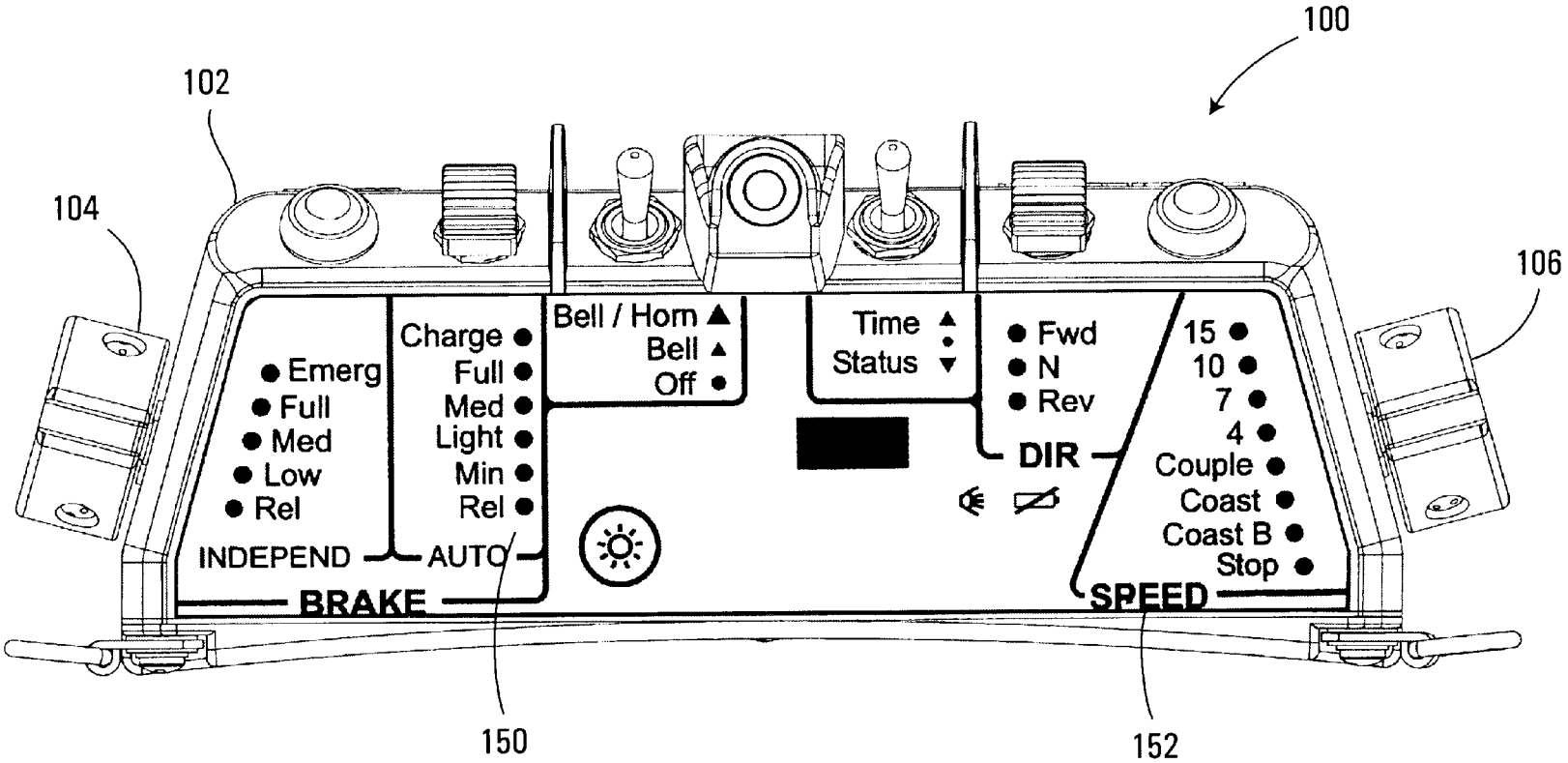
FIG. 1 is a diagram of a locomotive remote control unit in accordance with a non-limiting example of implementation of the present invention.

In the drawings, embodiments of the invention are illustrated by way of example. It is to be expressly understood that the description and drawings are only for purposes of illustration and as an aid to understanding, and are not intended to be a definition of the limits of the invention.

DETAILED DESCRIPTION

Under one possible form of implementation, the remote control unit is illustrated in FIG. 1 of the drawings in accordance with a non-limiting example of implementation of the invention. As depicted, the remote control module 100 is in the form of a portable module comprising a housing 102 that encloses the electronic circuitry (not shown) and a battery (not shown) supplying electrical power to operate the remote control unit 100. A plurality of manually operable control devices project outside the housing and are provided to allow an operator to select train speed (or throttle), brake, and other possible settings. Such manually operable control devices may be in the form or levers, switches, toggle switches, rotary knobs and push type switches where each actuation of the switch modifies a setting according to a certain pattern amongst others. For additional specific information on this topic and for general information on remote locomotive control systems the reader is invited to consult the U.S. Pat. Nos. 5,511,749 and 5,685,507 granted to CANAC International Inc. and the U.S. Pat. No. 4,582,280 assigned to the Harris Corp. The contents of these documents are incorporated herein by reference. Alternatively, the remote control module can be in the form of a console fixed in a locomotive.

As depicted, the remote control module 100 also includes a number of displays including a brake setting display 150 for displaying brake information and a speed setting display 152 for displaying speed setting information. Alternatively, the remote control module 100 may include a throttle setting display (not shown) instead or in addition to the speed setting display for displaying throttle setting information.

In a specific embodiment, the remote control unit 100 includes a manually operable control device 104 allowing an operator to select a brake setting among a set of brake settings, the brake settings in the set of brake settings corresponding to respective levels of brake application. The remote control unit 100 includes a manually operable control device 106 allowing an operator to select a speed setting among a set of speed settings. In an alternative specific embodiment (not shown in the figures), the remote control unit 100 includes a manually operable control device allowing an operator to select a throttle setting among a set of throttle settings.

The detailed description below refers to the brake setting display 150. The skilled person in the art will appreciate that the processes and display schemes described herein below may also be applied to the speed setting display 152 and the throttle setting display (not shown) and to the command information displays in general.

Figure 2:
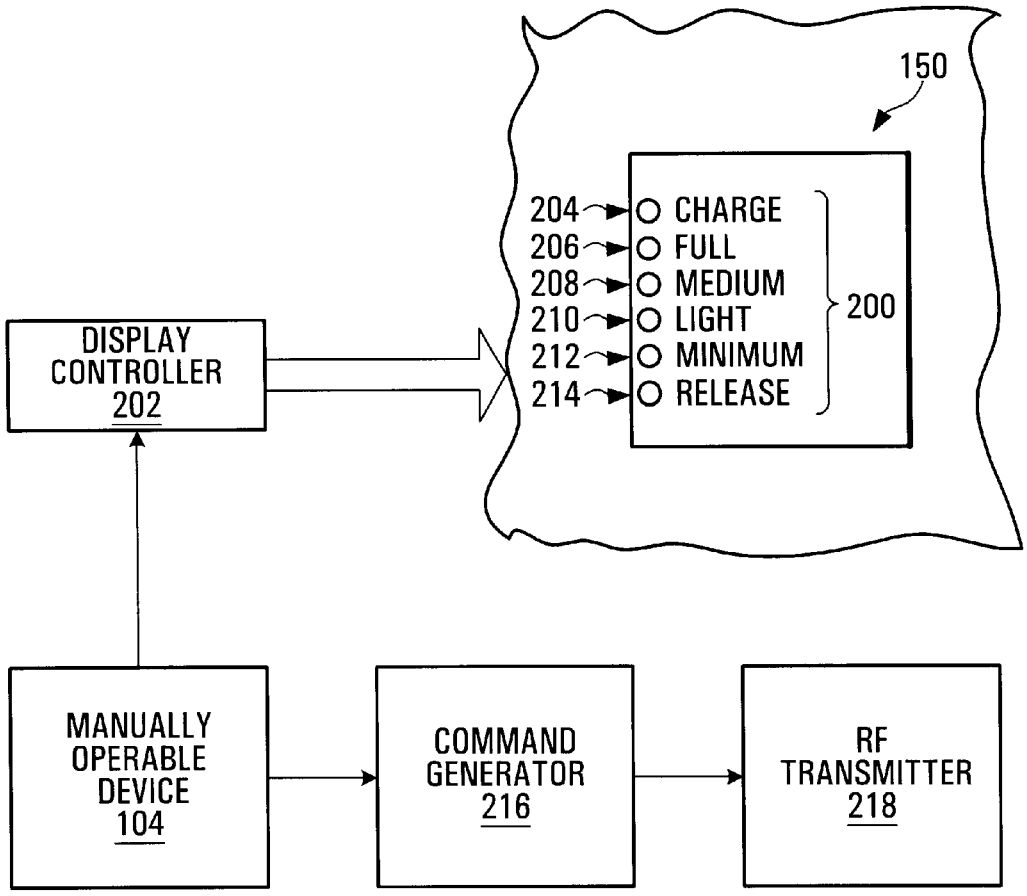
FIG. 2 is a functional block diagram of the diagram of a portion of the remote control unit of FIG. 1 relating to the automatic brake setting selection in accordance with a non-limiting example of implementation of the present invention.

FIG. 2 shows a functional block diagram a portion of the remote control unit relating to the automatic brake setting selection in accordance with a non-limiting example of implementation. As shown, the remote control unit includes a command generator 216, a RF transmitter 218, the manually operable control device 104, a display controller 202 and the brake setting display 150.

The command generator 216 is responsive to the manually operable control device 104 to produce a message for causing brakes of the locomotive to be applied at a level corresponding to the brake setting selected at the manually operable control device 104. The command generator 216 is in communication with transmitter 218 for producing an RF signal containing the message and transmitting the message to the locomotive.

The display controller 202 is in communication with manually operable control device 104 and with brake setting display 150. The selected brake setting selected by the manually operable control device 104 is communicated to display controller 202 which causes the current selected brake setting to be displayed to the operator on the brake setting display 150.

The brake setting display 150 includes an array of discrete display elements 200. The brake setting display shown in FIG. 2 is comprised of six light emitting diodes (LEDs) 204 206 208 210 212 214 forming the array of discrete display elements 200. The LEDs are associated with the following brake settings: release 214; minimum 212; light 210; medium 208; full 206; charge 204. Alternatively, suitable visual indicators other than LEDs may also be used as discrete display elements 200 providing without detracting from the spirit of the invention. It will be appreciated that the number of discrete display elements in the array 200 may vary and that fewer or greater numbers of discrete display elements may be used in different implementations. In a non-limiting example, the display elements that are linearly arranged in the brake setting display 150. In the implementation shown in FIG. 1, the display elements of the array are arranged along a straight line however diagonal arrangements may also be used without detracting from the spirit of the invention.

In a specific implementation, at least part of the discrete display elements are ordered in the array of the display elements 200 in continuously increasing or decreasing order accordingly to the levels of brake application to which the discrete display elements are associated. Ordering the discrete display elements in this fashion provide a visually intuitive display to the user of the remote control unit 100. In the figures, the brake settings minimum 212, light 210, medium 208 and full 206 correspond to respective levels of brake application and are ordered in increasing order of level of brake application from bottom to top.

Each discrete display element in the array 200 is adapted to acquire at least two distinct states namely an actuated state and a de-actuated state. The discrete display elements may be actuated in a plurality of different fashions. For the purpose of this specification, a discrete data element is "actuated" by making it visually distinct from other discrete data elements in the group of discrete data elements. In a specific implementation where the discrete data element is a light based indicator, non-limiting examples of actuation manners include:

- changing the discrete data element's color or intensity;
- switching the discrete data elements ON (actuated state) while the non-actuated discrete data elements are OFF (de-actuated state);
- switching the discrete data elements OFF (actuated state) while the non-actuated discrete data elements are ON (de-actuated state);
- switching the discrete data elements ON and OFF at a given frequency (flashing) (actuated state);
- or any other suitable method to visually distinguish the actuated discrete data element from other discrete data elements in the group of discrete data elements.

As a variant, each discrete display element in the array 200 is adapted to acquire at plurality of distinct actuated levels in addition to the de-actuated state. In a specific implementation of this variant where the discrete data element is a light based indicator, non-limiting examples of actuation manners include:

- changing the discrete data element's to a first color to show a first level of actuation, to a second color to show a second level of actuation and to a third color to show de-actuation;
- changing the discrete data element's to a first intensity level to show a first level of actuation, to a second intensity level to show a second level of actuation and to a third intensity level to show de-actuation;
- switching the discrete data elements ON and OFF at a certain frequency (flashing) for the first level of actuation, switching the discrete data elements ON (second level of actuation) while the non-actuated discrete data elements are OFF;
- switching the discrete data elements ON and OFF at a given frequency (flashing) for the first level of actuation, switching the discrete data elements OFF (second level of actuation) while the non-actuated discrete data elements are ON;
- any other suitable method to visually distinguish between the levels of actuation for actuated discrete data elements and de-actuated discrete data elements.

In light of the above description, it will be readily apparent that other combinations of examples of actuation to distinguish between different levels of actuation are possible without detracting from the spirit of the invention and as such will not be described further here.

Display controller 202 controls the actuation state of each discrete display element in the array of discrete display elements 200 to cause the current selected brake setting to be displayed to the operator on the brake setting display 150.

The display controller 202 implements a display scheme. In addition to the charge setting 204 and the release setting 214, the display module 150 includes four (4) discrete display element elements corresponding to respective levels of brake application namely minimum 212; light 210; medium 208 and full 206.

In accordance with a first aspect, the display controller actuates a first display element in the array 200 when a first brake setting corresponding to a first level of brake application is selected on the control device. The display controller actuates a second display element of the array 200 when a third brake setting corresponding to a third level of brake application is selected on the control device 104. The display controller actuates first and second display elements of the array when a second brake setting corresponding to a second level of brake application that is intermediate to the first and third levels of brake application is selected on the control device. Specific examples of specific implementations of the display scheme implemented by the display controller will better illustrate the above description.

In accordance with a first specific implementation of the display scheme, the display controller 202 implements a moving dot display on display module 150. This will be best understood with reference to FIGS. 3*a*–3*g* of the drawings.

Figure 3A:
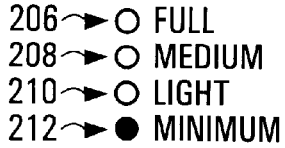
FIGS. 3*a* to 3*g* illustrate a first display scheme in accordance with a non-limiting example of implementation of the present invention.

In FIG. 3*a*, the display module 150 is shown where the first brake setting "Minimum" corresponding to a first level of brake application is selected by the control device. As shown, the display element 212 is actuated and the remaining display elements 210 208 206 are de-actuated.

Figure 3B:
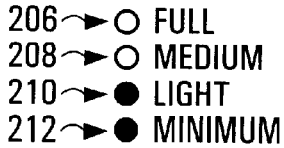
Figure 3C:
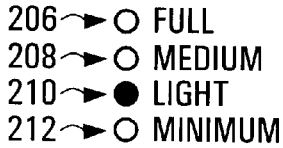

In FIG. 3*c*, the display module 150 is shown where the third brake setting "Light" corresponding to a third level of brake application is selected by the control device. The third level of brake application is a greater level of braking than the first level of braking. As shown, the display element 210 is actuated and the remaining display elements 212 208 206 are de-actuated.

In FIG. 3*b*, the display module 150 is shown where the second brake setting corresponding to a second level of brake application is selected by the control device 104. The second level of brake application is a level of brake application intermediate to the first and third levels of brake application. As shown, the display elements 210 and 212 are actuated and the remaining display elements 208 206 are de-actuated. In a non-limiting implementation, when the second brake setting is selected on the control device, the brake setting display actuates display elements 210 and 212 in an identical manner. As a variant, the brake setting display actuates display element 210 is a first manner and display element 212 in a second manner distinct from said first manner.

Figure 3D:
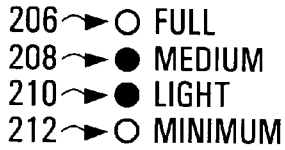
Figure 3E:
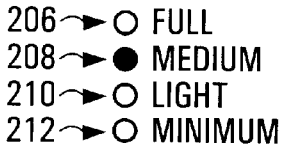

In FIG. 3*e*, the display module 150 is shown where the fifth brake setting "Medium" corresponding to a fifth level of brake application is selected by the control device. The fifth level of brake application is a greater level of braking than the third level of braking. As shown, the display element 208 is actuated and the remaining display elements 212 210 206 are de-actuated.

In FIG. 3*d*, the display module 150 is shown where the fourth brake setting corresponding to a fourth level of brake application is selected by the control device 104.

The fourth level of brake application is a level of brake application intermediate to the third and fifth levels of brake application. As shown, the display elements 210 and 208 are actuated and the remaining display elements 212 206 are de-actuated. In a non-limiting implementation, when the fourth brake setting is selected on the control device, the brake setting display actuates display elements 210 and 208 in an identical manner. As a variant, the brake setting display actuates display element 210 is a first manner and display element 208 in a second manner distinct from said first manner.

Figure 3F:
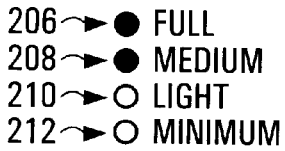

In FIG. 3*f*, the display module 150 is shown where the seventh brake setting "Full" corresponding to a seventh level of brake application is selected by the control device. The seventh level of brake application is a greater level of braking than the fifth level of braking. As shown, the display element 206 is actuated and the remaining display elements 212 210 208 are de-actuated.

Figure 3G:
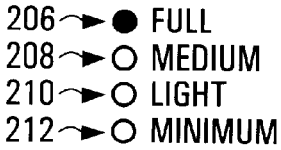

In FIG. 3*g*, the display module 150 is shown where the sixth brake setting corresponding to a sixth level of brake application is selected by the control device 104. The sixth level of brake application is a level of brake application intermediate to the fifth and seventh levels of brake application. As shown, the display elements 206 and 208 are actuated and the remaining display elements 212 210 are de-actuated. In a non-limiting implementation, when the sixth brake setting is selected on the control device, the brake setting display actuates display elements 206 and 208 in an identical manner. As a variant, the brake setting display actuates display element 206 is a first manner and display element 208 in a second manner distinct from said first manner.

In this fashion, four discrete display elements 212 210 208 206 display 7 different display settings. In a non-limiting implementation, the control device is adapted to modify the brake setting in the following sequence:

- from the first brake setting (FIG. 3*a*) to the second brake setting (FIG. 3*b*); and
- from the second brake setting (FIG. 3*b*) to the third brake setting (FIG. 3*c*);
- from the third brake setting (FIG. 3*c*) to the fourth brake setting (FIG. 3*d*);
- from the fourth brake setting (FIG. 3*d*) to the fifth brake setting (FIG. 3*e*);
- from the fifth brake setting (FIG. 3*e*) to the sixth brake setting (FIG. 3*f*);
- from the sixth brake setting (FIG. 3*f*) to the seventh brake setting (FIG. 3*g*).

In accordance with a second embodiment of the display scheme implemented by display controller 202, the display module implements a bar graph display on display module 150.

This will be best understood with reference to FIGS. 4*a*–4*g* of the drawings.

In FIG. 4*a*, the display module 150 is shown where the first brake setting "Minimum" corresponding to a first level of brake application is selected by the control device. As shown, the display element 212 is actuated and the remaining display elements 210 208 206 are de-actuated.

In FIG. 4*c*, the display module 150 is shown where the third brake setting "Light" corresponding to a third level of brake application is selected by the control device. The third level of brake application is a greater level of braking than the first level of braking. As shown, the display elements 210 and 212 are actuated in the same manner and the remaining display elements 208 206 are de-actuated.

In FIG. 4*b*, the display module 150 is shown where the second brake setting corresponding to a second level of brake application is selected by the control device 104. The second level of brake application is a level of brake application intermediate to the first and third levels of brake application. As shown, the display element 210 and 212 are actuated and the remaining display elements 208 206 are de-actuated. When the second brake setting is selected on the control device, the brake setting display actuates display element 210 is a first manner and display element 212 in a second manner distinct from said first manner. In a specific non-limiting implementation, when the second brake setting is selected on the control device, the brake setting display turns "ON" the LED for display element 210 and turns "ON" and "OFF" repetitively (flashing) the LED for display element 212.

In FIG. 4*e*, the display module 150 is shown where the fifth brake setting "Medium" corresponding to a fifth level of brake application is selected by the control device. The fifth level of brake application is a greater level of braking than the third level of braking. As shown, the display elements 208 210 and 212 are actuated is a same manner and the remaining display element 206 is de-actuated.

In FIG. 4*d*, the display module 150 is shown where the fourth brake setting corresponding to a fourth level of brake application is selected by the control device 104. The fourth level of brake application is a level of brake application intermediate to the third and fifth levels of brake application. As shown, the display elements 212 and 210 are actuated in a first manner and display element 208 is actuated in a second manner distinct from said first manner and the remaining display element 206 is de-actuated.

In FIG. 4*g*, the display module 150 is shown where the seventh brake setting "Full" corresponding to a seventh level of brake application is selected by the control device. The seventh level of brake application is a greater level of braking than the fifth level of braking. As shown, the display element 212 210 208 and 206 are actuated in a same manner.

In FIG. 4*f*, the display module 150 is shown where the sixth brake setting corresponding to a sixth level of brake application is selected by the control device 104. The sixth level of brake application is a level of brake application intermediate to the fifth and seventh levels of brake application. As shown, the display elements 212 210 208 are actuated in a first manner, display element 206 is actuated in a second manner.

In accordance with a second aspect, the display controller actuates a display element in the array 200 in a first manner of actuation when a first brake setting corresponding to a first level of brake application is selected on the control device. The display controller actuates the display element of the array 200 in a second manner of actuation when a second brake setting corresponding to a second level of brake application is selected on the control device 104, the second manner of actuation being distinct from the first manner of actuation. A specific example of specific implementations of a display scheme in accordance with a second aspect will better illustrate the above description.

In accordance with a first embodiment of the display scheme implemented by display controller 202, the display module implements a moving dot display on display module 150. This will be best understood with reference to FIGS. 6*a*–6*g* of the drawings.

Figure 6A:
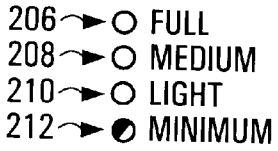
FIGS. 6*a* to 6*h* illustrate a third display scheme in accordance with another non-limiting example of implementation of the present invention.

In FIG. 6*a*, the display module 150 is shown where a first brake setting corresponding to a first level of brake application is selected by the control device. As shown, the display element 212 is actuated in accordance with a first manner of actuation and the remaining display elements 210 208 206 are de-actuated.

Figure 6B:
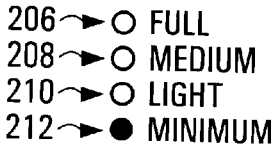

In FIG. 6*b*, the display module 150 is shown where the second brake setting corresponding to a second level of brake application is selected by the control device. The second level of brake application is a greater level of braking than the first level of braking. As shown, the display element 212 is actuated in accordance with a second manner of actuation and the remaining display elements 210 208 206 are de-actuated.

Figure 6C:
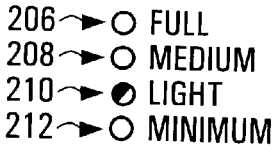

In FIG. 6*c*, the display module 150 is shown where the third brake setting corresponding to a third level of brake application is selected by the control device 104. As shown, display element 210 is actuated in accordance with a first manner of actuation and the remaining display elements 212 208 206 are de-actuated.

Figure 6D:
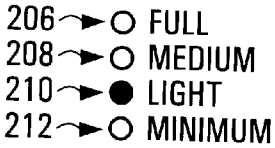

In FIG. 6*d*, the display module 150 is shown where the fourth brake setting corresponding to a fourth level of brake application is selected by the control device. The fourth level of brake application is a greater level of braking than the third level of braking. As shown, the display element 210 is actuated in accordance with a second manner of actuation and the remaining display elements 212 208 206 are de-actuated.

Figure 6E:
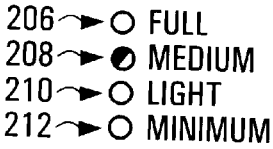

In FIG. 6*e*, the display module 150 is shown where the fifth brake setting corresponding to a fifth level of brake application is selected by the control device 104. As shown, display element 208 is actuated in accordance with a first manner of actuation and the remaining display elements 212 210 206 are de-actuated.

Figure 6F:
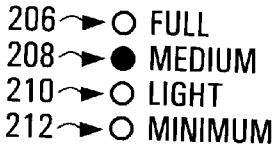

In FIG. 6*f*, the display module 150 is shown where the sixth brake setting corresponding to a sixth level of brake application is selected by the control device. The sixth level of brake application is a greater level of braking than the fifth level of braking. As shown, the display element 208 is actuated in accordance with a second manner of actuation and the remaining display elements 212 210 206 are de-actuated.

Figure 6G:
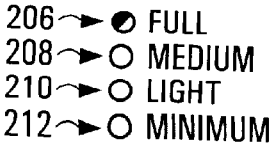

In FIG. 6*g*, the display module 150 is shown where the seventh brake setting corresponding to a seventh level of brake application is selected by the control device 104. As shown, display element 206 is actuated in accordance with a first manner of actuation and the remaining display elements 212 210 208 are de-actuated.

Figure 6H:
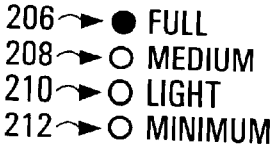

In FIG. 6*h*, the display module 150 is shown where the eighth brake setting corresponding to an eighth level of brake application is selected by the control device. The eighth level of brake application is a greater level of braking than the seventh level of braking. As shown, the display element 206 is actuated in accordance with a second manner of actuation and the remaining display elements 212 210 208 are de-actuated.

In accordance with a second embodiment of the display scheme implemented by display controller 202, the display module implements a bar graph display on display module 150.

In accordance with this second aspect, four discrete display elements 212 210 208 206 display 8 different display settings.

Those skilled in the art should appreciate that in some embodiments of the invention, all or part of the functionality previously described herein with respect to the display controller 202 may be implemented as pre-programmed hardware or firmware elements (e.g., application specific integrated circuits (ASICs), electrically erasable programmable read-only memories (EEPROMs), etc.), or other related components. Optionally, the remote control unit includes a port in communication with the display controller 202 allowing the display scheme implemented by the display controller to be modified by a software component without removing the display controller 202 from the housing 102. The port may be in any suitable format including but not limited to a serial port, infra-red port, parallel port, modem port, Ethernet port, optical port and USB port.

In other embodiments of the invention, all or part of the functionality previously described herein with respect to the display controller 202 may be implemented as software consisting of a series of instructions for execution by a processor. The series of instructions could be stored on a medium which is fixed, tangible and readable directly by the computing unit, (e.g., removable diskette, CD-ROM, ROM, PROM, EPROM or fixed disk), or the instructions could be stored remotely but transmittable to the processor via a modem or other interface device (e.g., a communications adapter) connected to a network over a transmission medium. The transmission medium may be either a tangible medium (e.g., optical or analog communications lines) or a medium implemented using wireless techniques (e.g., microwave, infrared or other transmission schemes).

Figure 5:
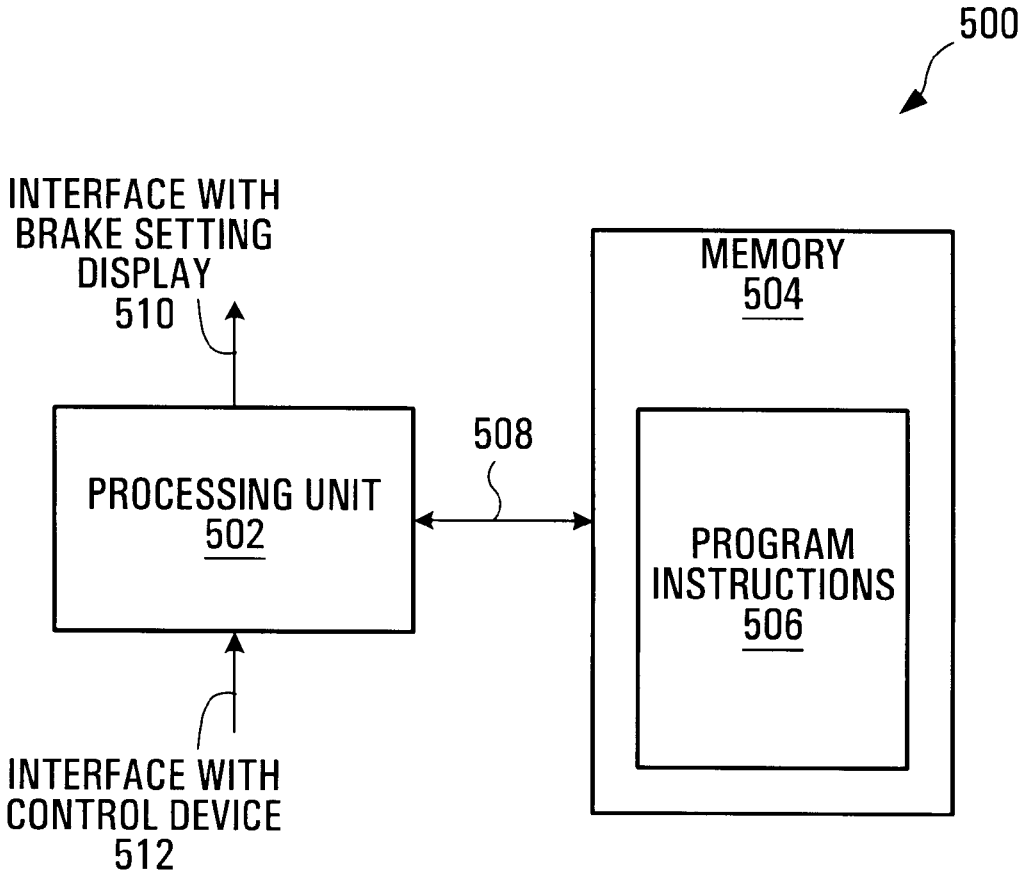
FIG. 5 is a block diagram of a display controller in accordance with a non-limiting example of implementation of the present invention.

The processor implementing the display controller may be configured as a computing unit of the type depicted in FIG. 5, including a processing unit 502 and a memory 504 connected by a communication bus 508. The memory 504 includes program instructions 506. The processing unit 502 is adapted to process the program instructions 506 in order to implement a display scheme described in the specification and depicted in the drawings. The computing unit 500 may also comprise a first interface 510 for communicating with the brake setting display 150 and a second interface 512 with the control device 104. Optionally, the computing unit 500 may include an additional interface (not shown) for receiving new program element modifying the program instructions 506 in memory 504 for implementing an alternative display scheme.

Although various embodiments have been illustrated, this was for the purpose of describing, but not limiting, the invention. Various modifications will become apparent to those skilled in the art and are within the scope of this invention, which is defined more particularly by the attached claims.

We claim:

1. A remote control unit for controlling a locomotive, said remote control unit comprising:

a) a manually operable control device allowing an operator to select a brake setting among a set of brake settings, the brake settings in the set of brake settings corresponding to respective levels of brake application;

b) a brake setting display including an array of discrete display elements;

c) a display controller in communication with said control device and with said brake setting display, said display controller being responsive to said manually operable control device to:

i) actuate a first display element of said array when a first brake setting is selected on said control device, corresponding to a first level of brake application;

ii) actuate a second display element adjacent to said first display element when a third brake setting is selected on said control device, corresponding to a third level of brake application;

iii) actuate said first and second display elements of said array when a second brake setting is selected on said control device, corresponding to a second level of brake application that is intermediate to said first and third levels of brake application.

2. A remote control unit as defined in claim 1, wherein said remote control unit is portable.

3. A remote control unit as defined in claim 2, wherein said display module is a moving dot display.

4. A remote control unit as defined in claim 3, wherein said array includes display elements that are linearly arranged.

5. A remote control unit as defined in claim 4, wherein when the first brake setting is selected on said control device corresponding to a first level of brake application, said brake setting display is operative to actuate said first display element, and de-actuate said second display element.

6. A remote control unit as defined in claim 5, wherein when the third brake setting is selected on said control device corresponding to the third level of brake application, said brake setting display is operative to actuate said second display element, and de-actuate said first display element.

7. A remote control unit as defined in claim 6, wherein when the second brake setting is selected on said control device, corresponding to the second level of brake application, said brake setting display is operative to actuate said first display element and said second display element in an identical manner.

8. A remote control unit as defined in claim 6, wherein when the second brake setting is selected on said control device, corresponding to the second level of brake application, said brake setting display is operative to actuate said first display element and said second display element in distinct manners.

9. A remote control unit as defined in claim 6, wherein the display elements of said array are arranged along a straight line.

10. A remote control unit as defined in claim 9, wherein the display elements of said array are light emitting diodes (LEDs).

11. A remote control unit as defined in claim 10, further comprising a command generator in communication with said control device, said command generator being responsive to said control device to produce a message for causing brakes of the locomotive to be applied at a level corresponding to the brake setting selected at said manually operable control device.

12. A remote control unit as defined in claim 11, further comprising a transmitter in communication with said command generator for producing an RF signal containing the message.

13. A remote control unit as defined in claim 2, wherein said display module is a bar graph display.

14. A remote control unit for controlling a locomotive, said remote control unit comprising:

a) a manually operable control device allowing an operator to select a speed setting among a set of speed settings;

b) a speed setting display including an array of discrete display elements;

c) a display controller in communication with said control device and with said speed setting display, said display controller being responsive to said manually operable control device to:

i) actuate a first display element of said array when a first speed setting is selected on said control device;

ii) actuate a second display element adjacent to said first display element when a third speed setting is selected on said control device;

iii) actuate said first and second display elements of said array when a second speed setting is selected on said control device, the second speed setting being intermediate to said first and third speed settings.

15. A remote control unit as defined in claim 14, wherein said remote control unit is portable.

16. A remote control unit as defined in claim 15, wherein said display module is a moving dot display.

17. A remote control unit as defined in claim 16, wherein said array includes display elements that are linearly arranged.

18. A remote control unit as defined in claim 17, wherein when the first speed setting is selected on said control device, said speed setting display is operative to actuate said first display element, and de-actuate said second display element.

19. A remote control unit as defined in claim 18, wherein when the third speed setting is selected on said control device, said speed setting display is operative to actuate said second display element, and de-actuate said first display element.

20. A remote control unit as defined in claim 19, wherein when the second speed setting is selected on said control device, said speed setting display is operative to actuate said first display element and said second display element in an identical manner.

21. A remote control unit as defined in claim 19, wherein when the second speed setting is selected on said control device, said speed setting display is operative to actuate said first display element and said second display element in distinct manners.

22. A remote control unit as defined in claim 20, wherein the display elements of said array are arranged along a straight line.

23. A remote control unit as defined in claim 22, wherein the display elements of said array are light emitting diodes (LEDs).

24. A remote control unit as defined in claim 23, further comprising a command generator in communication with said control device, said command generator being responsive to said control device to produce a message for the locomotive to move at a speed corresponding to the speed setting selected at said manually operable control device.

25. A remote control unit as defined in claim 24, further comprising a transmitter in communication with said command generator for producing an RF signal containing the message.

26. A remote control unit as defined in claim 15, wherein said display module is a bar graph display.

27. A remote control unit for controlling a locomotive, said remote control unit comprising:

a) a manually operable control device allowing an operator to select a throttle setting among a set of throttle settings;

b) a throttle setting display including an array of discrete display elements;

c) a display controller in communication with said control device and with said throttle setting display, said display controller being responsive to said manually operable control device to:

i) actuate a first display element of said array when a first throttle setting is selected on said control device;

ii) actuate a second display element adjacent to said first display element when a third throttle setting is selected on said control device;

iii) actuate said first and second display elements of said array when a second throttle setting is selected on said control device, the second throttle setting being intermediate to said first and third throttle settings.

28. A remote control unit as defined in claim 27, wherein said remote control unit is portable.

29. A remote control unit as defined in claim 28, wherein said display module is a moving dot display.

30. A remote control unit as defined in claim 29, wherein said array includes display elements that are linearly arranged.

31. A remote control unit as defined in claim 30, wherein when the first throttle setting is selected on said control device, said throttle setting display is operative to actuate said first display element, and de-actuate said second display element.

32. A remote control unit as defined in claim 31, wherein when the third throttle setting is selected on said control device, said throttle setting display is operative to actuate said second display element, and de-actuate said first display element.

33. A remote control unit as defined in claim 32, wherein when the second throttle setting is selected on said control device, said throttle setting display is operative to actuate said first display element and said second display element in an identical manner.

34. A remote control unit as defined in claim 33, wherein the display elements of said array are arranged along a straight line.

35. A remote control unit as defined in claim 34, wherein the display elements of said array are light emitting diodes (LEDs).

36. A remote control unit as defined in claim 35, further comprising a command generator in communication with said control device, said command generator being responsive to said control device to produce a message for the locomotive to move at a throttle corresponding to the throttle setting selected at said manually operable control device.

37. A remote control unit as defined in claim 36, further comprising a transmitter in communication with said command generator for producing an RF signal containing the message.

38. A remote control unit as defined in claim 32, wherein when the second throttle setting is selected on said control device, said throttle setting display is operative to actuate said first display element and said second display element in distinct manners.

39. A remote control unit as defined in claim 28, wherein said display module is a bar graph display.

40. A remote control unit for controlling a locomotive, said remote control unit comprising:

a) a manually operable control device allowing an operator to select a brake setting among a set of brake settings, the brake settings in the set of brake settings corresponding to respective levels of brake application;

b) a brake setting display including an array of discrete display elements;

c) a display controller in communication with said control device and with said brake setting display, said display controller being responsive to said manually operable control device to:

i) actuate a first display element of said array in a first manner of actuation when a first brake setting is selected on said control device, corresponding to a first level of brake application;

ii) actuate the first display element in a second manner of actuation when a second brake setting is selected on said control device, corresponding to a second level of brake application, the second manner of actuation being distinct from said first manner of actuation.

41. A remote control unit as described in claim 40, wherein said display controller being responsive to said manually operable control device to:

a) actuate a second display element of said array in a first manner of actuation when a third brake setting is selected on said control device, corresponding to a third level of brake application;

b) actuate the second display element in a second manner of actuation when a fourth brake setting is selected on said control device, corresponding to a fourth level of brake application.

42. A remote control unit for controlling a locomotive, said remote control unit comprising:

a) manual input means allowing an operator to select a brake setting among a set of brake settings, the brake settings in the set of brake settings corresponding to respective levels of brake application;

b) brake setting display means including an array of discrete display elements;

c) display control means in communication with said manual input means and with said brake setting display means, said display control means being responsive to said manual input means to:

i) actuate a first display element of said array when a first brake setting is selected on said manual input means, corresponding to a first level of brake application;

ii) actuate a second display element adjacent to said first display element when a third brake setting is selected on said manual input means, corresponding to a third level of brake application;

iii) actuate said first and second display elements of said array when a second brake setting is selected on said manual input means, corresponding to a second level of brake application that is intermediate to said first and third levels of brake application.

43. A remote control unit for controlling a locomotive, said remote control unit comprising:

a) manual input means allowing an operator to select a speed setting among a set of speed settings;

b) speed setting display means including an array of discrete display elements;

c) display control means in communication with said manual input means and with said speed setting display means, said display control means being responsive to said manual input means to:

i) actuate a first display element of said array when a first speed setting is selected on said manual input means;

ii) actuate a second display element adjacent to said first display element when a third speed setting is selected on said manual input means;

iii) actuate said first and second display elements of said array when a second speed setting is selected on said manual input means, the second speed setting being intermediate to said first and third speed settings.

44. A remote control unit for controlling a locomotive, said remote control unit comprising:

a) manual input means allowing an operator to select a throttle setting among a set of throttle settings;

b) throttle setting display means including an array of discrete display elements;

c) display control means in communication with said manual input means and with said throttle setting display means, said display control means being responsive to said manual input means to:

i) actuate a first display element of said array when a first throttle setting is selected on said manual input means;

ii) actuate a second display element adjacent to said first display element when a third throttle setting is selected on said manual input means;

iii) actuate said first and second display elements of said array when a second throttle setting is selected on said manual input means, the second throttle setting being intermediate to said first and third throttle settings.

* * * * *